US005749246A

United States Patent [19]

Rottmann

[11] Patent Number: 5,749,246

[45] Date of Patent: May 12, 1998

[54] METHOD AND DEVICE FOR OBTAINING OXYGEN AND NITROGEN AT SUPERATMOSPHERIC PRESSURE

[75] Inventor: Dietrich Rottmann, München, Germany

[73] Assignee: Linde Aktiengesellschaft, Wiesbaden, Germany

[21] Appl. No.: 756,012

[22] Filed: Nov. 25, 1996

[30] Foreign Application Priority Data

Nov. 25, 1995 [DE] Germany ..... 195 43 953.8

[51] Int. Cl.[6] ..... F25J 3/04

[52] U.S. Cl. ..... 62/654

[58] Field of Search ..... 62/654, 924

[56] References Cited

U.S. PATENT DOCUMENTS 4,006,001 2/1977 Schonpflug ..... 62/654

5,195,324 3/1993 Cheung ..... 62/654

*Primary Examiner*—Christopher Kilner

*Attorney, Agent, or Firm*—Millen, White, Zelane, & Branigan, P.C.

[57] ABSTRACT

The method and the apparatus are used to obtain oxygen and nitrogen at superatmospheric pressure by low-temperature separation of air in a rectification column system. Compressed and purified feed air (1, 3) is introduced into a pressure column (4). Liquids (5, 8) from the lower region and, respectively, from the upper or middle region of the pressure column (4) are fed into the low-pressure column (7). A third liquid fraction (17) from the lower region of the low-pressure column (7) is evaporated in indirect heat exchange (12) with condensing vapour (11) from the upper region of the pressure column (4), at least a portion of the vapour (22, 24, 26, 27) obtained in the process being introduced into the low-pressure column (7). Condensate (13) is fed into the pressure column (4); A pressurized nitrogen fraction (10, 14, 15) is extracted as product from the upper region of the pressure column (4). The pressure of the third liquid fraction (17) from the lower region of the low-pressure column (17) is increased upstream of the indirect heat exchange (12); that portion (24) of the vapor which is obtained during the indirect heat exchange and led back into the low-pressure column is expanded (25) before being introduced (27) into the low-pressure column (7).

11 Claims, 3 Drawing Sheets

METHOD AND DEVICE FOR OBTAINING OXYGEN AND NITROGEN AT SUPERATMOSPHERIC PRESSURE

BACKGROUND OF THE INVENTION

The invention relates to a method and apparatus for obtaining oxygen and nitrogen at superatmospheric pressure by low-temperature separation of air in a rectification column system which has a pressure column and a low-pressure column, having the steps (a) to (g) set forth in Patent claim 1.

A method having these steps is disclosed in U.S. Pat. No. 4,224,045. The pressure column and low-pressure column are thermally coupled by a condenser/evaporator arranged in the sump of the low-pressure column. The pressurized nitrogen product is extracted at the head of the pressure column. If it is also desired to obtain the oxygen product, which is obtained in the low-pressure column, under pressure, it is possible either to operate the entire double column or at least the low-pressure column at an appropriately increased pressure, or to pressurize the oxygen product in the liquid state and subsequently to evaporate it against feed air (internal compression). Cold could be produced either by expanding nitrogen-rich residual gas from the low-pressure column (possible only in the first case), or by expanding a portion of the feed air into the low-pressure column (as shown in U.S. Pat. No. 4,224,045) . Both the direct feed of air and the operation of the low-pressure column at an increased pressure worsen the rectification in the low-pressure column, however, and thereby reduce the yield and/or purity of the oxygen product.

SUMMARY OF THE INVENTION

It is therefore the object of the invention to specify a method and a corresponding apparatus of the type mentioned at the beginning by means of which oxygen and nitrogen can be obtained simultaneously at superatmospheric pressure, and which, in particular, operate economically, in particular owing to a high yield of oxygen.

This object is achieved by virtue of the fact that the pressure of the liquid from the lower region the low-pressure column is increased upstream of the indirect heat exchange with condensing vapour from the upper region of the pressure column, and that portion of the vapour which is obtained during the indirect heat exchange and is led back into the low-pressure column is expanded before being introduced into the low-pressure column.

According to the invention, the pressures of the pressure column and low-pressure column are thus decoupled, that is to say the pressure column can be operated at a particularly high pressure (for example 8 bars, 10 bars or higher), whereas the pressure in the low-pressure column is only at just above atmospheric pressure, for example at 1.2 to 2.0 bars, preferably 1.5 to 1.6 bars. It is therefore possible for the pressure in the pressure column to be determined by the desired nitrogen product pressure—with the result that the nitrogen product compressor can either be of smaller design or be completely eliminated—and the low-pressure column can, nevertheless, be operated with an optimum separation effect. The pressure of the liquid from the lower region of the low-pressure column can be raised by any of the known methods, for example by a pump and/or by a hydrostatic potential. The final pressure must suffice for the liquid to be evaporated from the pressure column during the indirect heat exchange with the vapour condensing at the pressure of the pressure column.

The indirect heat exchange serves, on the one hand, to cool the head of the pressure column—a liquid return is produced for the pressure column and, possibly, for the low-pressure column—and, on the other hand, to produce rising vapour for the low-pressure column—via the detour of an oxygen circuit with an increase of pressure in the liquid and gaseous expansion.

The vapour obtained during the indirect heat exchange is preferably heated up against feed air. As a rule, only a portion of the heated-up gas is expanded into the low-pressure column. The remainder can then further be heated to ambient temperature and be withdrawn as gaseous pressurized oxygen product.

In the case of the invention, it is favourable for at least partially ordered, preferably exclusively ordered, packings to be used as material exchange elements in the low-pressure column. Owing to their particularly slight pressure loss, the pressure in the lower region of the low-pressure column can be further depressed.

The two liquids, which are led from the pressure column into the low-pressure column, consist as a rule of the sump liquid of the pressure column (first liquid fraction), or, respectively, of liquid from the head of the pressure column or from an intermediate point which is situated 10 to 30, preferably 20 theoretical plates below the head of the pressure column (second liquid fraction).

The expansion of the vapour obtained during the indirect heat exchange by evaporation of the liquid from the lower region of the low-pressure column is preferably carried out in a fashion performing work, for example in an expansion turbine. A particularly high level of process cold can thereby be obtained. It is favourable for a turbine having magnetic or gas bearings to be used as expansion turbine.

At least a portion of the energy generated during the expansion of the vapour obtained during the indirect heat exchange can be used to compress a process stream, for example to compress a nitrogen-containing fraction from the low-pressure column to the pressure required to regenerate a molecular sieve unit. The devices for expanding or compressing are preferably mechanically coupled, for example by a common shaft.

The vapour obtained during the indirect heat exchange can be heated upstream of the expansion into the lower-pressure column. This heating is preferably performed in a main heat exchanger which is also used to cool the feed air. The portion, which is to be expanded, of the vapour is in this case generally led out of the main heat exchanger at a temperature which is situated between the temperatures at the cold and warm ends of the main heat exchanger.

A portion of the vapour obtained during the indirect heat exchange—for example that vapour which is not fed to the expansion—is preferably obtained as pressurized oxygen product. This purpose is served by a single device, as a rule an oxygen pump—for generating the increased pressure both for the product quantity and for the quantity conducted in the circuit for the purpose of generating cold.

Because of the favourable conditions by virtue of the low pressure in the low-pressure column, the method according to the invention is also suitable for obtaining argon. For this purpose, an argon-containing fraction can be introduced from the low-pressure column into a raw argon column. Details on obtaining argon in this way are described, for example, in EP-B-377117, EP-A-628777 or EP-A-669569.

The invention also relates to a apparatus for obtaining oxygen and nitrogen at superatmospheric pressure by low-temperature separation of air in accordance with Patent claims 7 to 11.

BRIEF DESCRIPTION OF THE FIGURES

The invention is explained in more detail below, together with further details of the invention, with the aid of exemplary embodiments schematically represented in the drawings, in which.

DETAILED DESCRIPTION OF THE FIGURES

Figure 1:
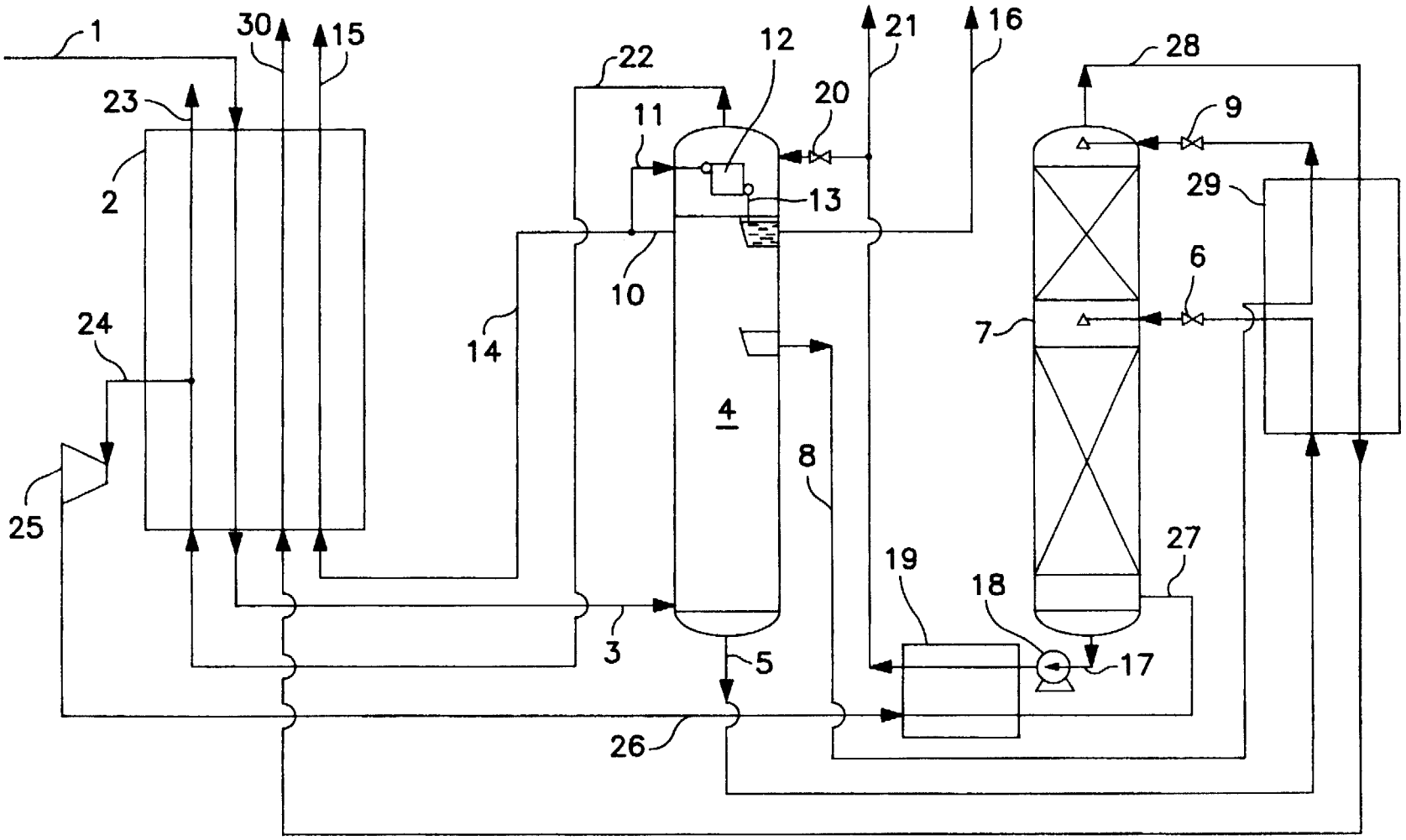
FIG. 1 shows a first, particularly preferred exemplary embodiment of the method and of the apparatus device according to the invention.

Compressed feed air 1 which has been cleaned of water and carbon dioxide is cooled in a main heat exchanger 2 to approximately the dew point, and fed into a pressure column 4 via a line 3 at a pressure of 10 bars. At the head of the pressure column, gaseous nitrogen, which still contains approximately 1 ppm of contaminants, is extracted via the line 10 and partly 11 condensed in a condenser/evaporator 12 constructed as a head condenser; the residue is led via a line 14 to the main heat exchanger 2, where it is heated to approximately ambient temperature, and is withdrawn at 15 as a gaseous pressurized product. The condensate 13 obtained in the condenser/evaporator 12 is, on the one hand, used as return for, the pressure column 4; on the other hand, it can be partially withdrawn as liquid product 16.

Oxygen-enriched sump liquid 5 is expanded (6) as first liquid fraction from the pressure column into a low-pressure column 7. A second liquid fraction 8 is extracted 20 theoretical, plates below the head of the pressure column and expanded 9 above the first liquid fraction, preferably at the head, into the low-pressure column. (As an alternative, or in addition, it would also be possible for the liquid extracted via the line 16 to be fed to the low-pressure column 7.)

The sump liquid of the low-pressure column 7 (third liquid fraction 17) is brought to a pressure of approximately 5 bars by: a pump 18, supercooled in a counterflow apparatus and introduced into the evaporation chamber of the condenser/evaporator 12. If desired, a portion of the pumped liquid can be extracted as product 21. The vapour 22 obtained in the condenser/evaporator 12 is introduced into the main heat exchanger 2 and obtained in part at the warm end 23 of the latter as gaseous pressurized product. The remainder, e.g., about 65–80% of vapour 22, is led out (24) at an intermediate point from the heat exchanger 2, is work expanded in a turbine 25 to approximately the pressure of the low-pressure column, and fed back into the low-pressure column 7 through the counterflow apparatus.

Nitrogen-containing residual gas 28 is extracted from the head of the low-pressure column 7, initially heated up (29) in relation to the two liquid fractions from the pressure column, and finally led further to the main heat exchanger 2. The heated-up residual gas 30 can, for example, be discarded or used as regenerative gas for a molecular sieve unit for purifying air.

Figure 2:
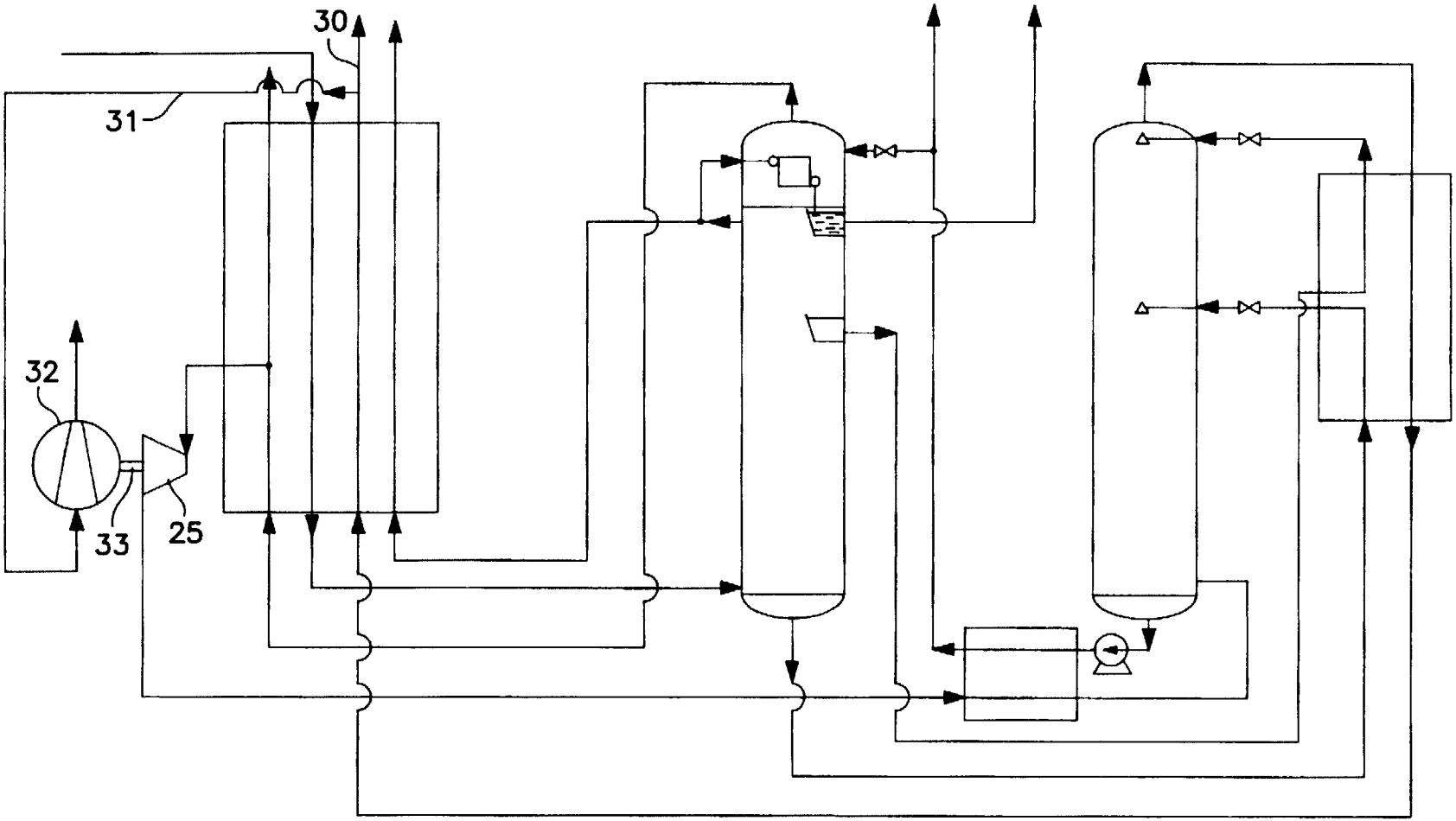
FIG. 2 shows a further exemplary embodiment with recompression of the nitrogen-rich residual gas from the low-pressure column.

In the latter case, it is favourable if that portion 31 of the residual gas 30 which is required for the regeneration is brought in a compressor 32 to the regeneration pressure, as is shown in FIG. 2. (FIG. 2 corresponds to FIG. 1 except for this detail.) The latter can be driven by the turbine 25—for example via a common shaft 33. It is possible with the aid of this measure further to lower the pressure in the low-pressure column, for example to approximately 1.1 bar. This, in turn, permits a reduction in the turbine outlet pressure, and thus an increase in the cooling capacity potential.

Figure 3:
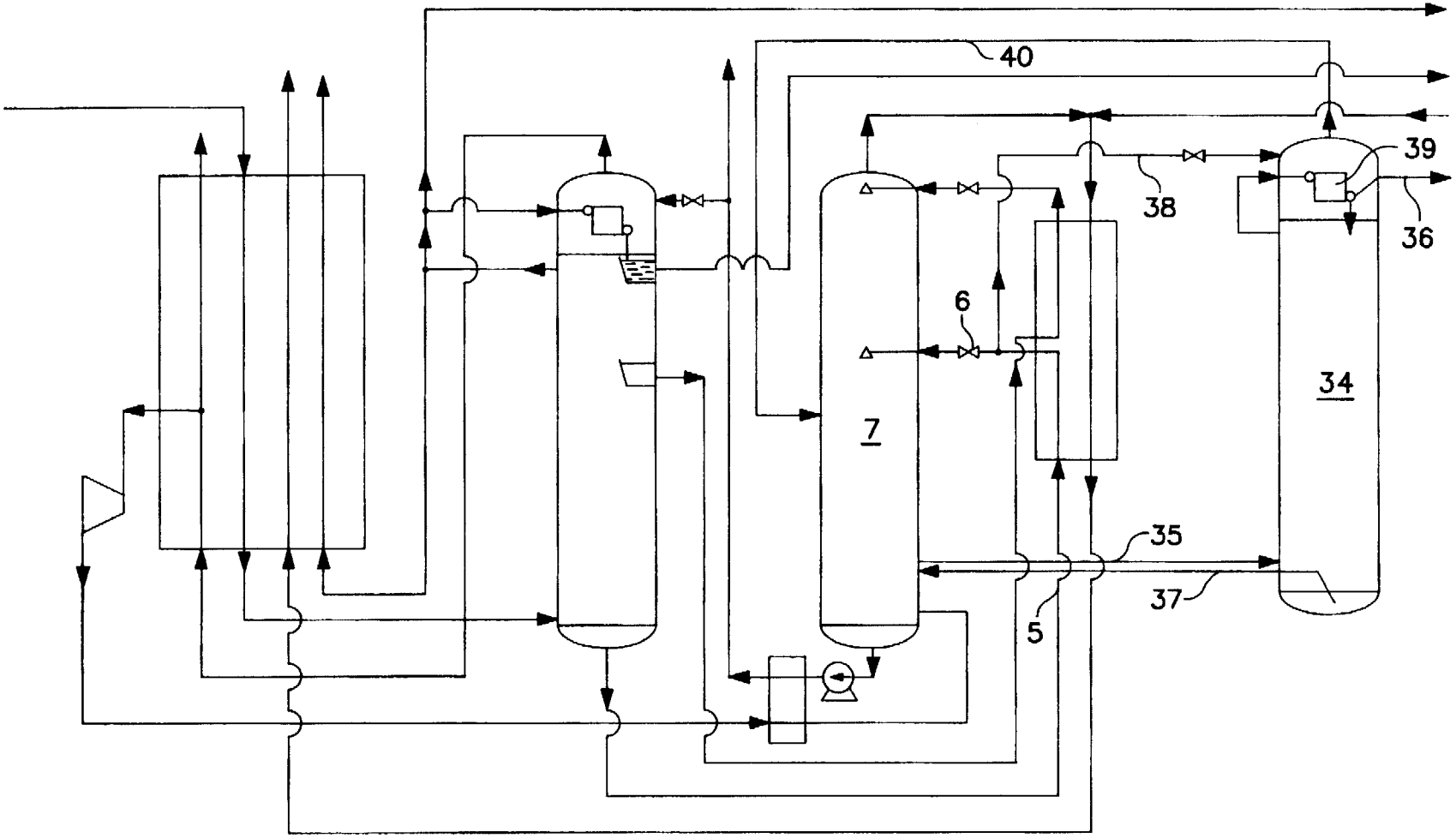
FIG. 3 shows a third exemplary embodiment in which argon is obtained.

The two exemplary embodiments can, in addition, be equipped with a raw argon column 34; this is shown in detail in FIG. 3 for the case of FIG. 1. An argon-containing vapour fraction 35 is led from a point of relatively high argon content in the low-pressure column 7 to the raw argon column 34, and separated there into a raw argon fraction—withdrawn, for example, in the liquid state via a line 36—and into a residual fraction 37. The head cooling 39 of the raw argon column 34 is effected by evaporating a portion 38 of the sump liquid 5 from the pressure column. The vapour 40 produced in this case is fed into the low-pressure column 7.

In the exemplary embodiments, the material exchange elements are formed in the pressure column by distillation plates, while those in the low-pressure column and, possibly, in the raw argon column are formed by ordered packings. However, in principle it is possible in the case of the invention to use conventional distillation plates, fillers (unordered packings) and/or ordered packings in all the columns. Combinations of various sorts of elements are also possible in a column. Because of the low pressure loss, ordered packings are preferred, particularly in the low-pressure column.

The preceding examples can be repeated with similar success by substituting the generically or specifically described reactants and/or operating conditions of this invention for those used in the preceding examples.

The entire disclosure of all applications, patent and publications, cited above and below, and of corresponding German application 194 43 953.8, are hereby incorporated by reference.

From the foregoing description, one skilled in the art can easily ascertain the essential characteristics of the invention, and without departing from the spirit and scope thereof, can make various changes and modifications of the invention to adapt it to various usages and conditions.

I claim:

1. A method for obtaining oxygen and nitrogen at superatmospheric pressure by low-temperature separation of air in a rectification column system which has a pressure column (4) and a low-pressure column (7), having the following steps:

(a) introducing compressed and purified feed air (1, 3) into the pressure column (4), (b) introducing (6) at least a portion of a first liquid fraction (5) from the lower region of the pressure column (4) into the low-pressure column (7), (c) introducing (9) a second liquid fraction (8) from the upper or middle region of the pressure column (4) into the low-pressure column (7), (d) evaporating a third liquid fraction (17) from the lower region of the low-pressure column (7) in indirect heat exchange (12) with condensing vapour (11) from the upper region of the pressure column (4), (e) introducing at least a portion of the vapour (22, 24, 26, 27) obtained during the indirect heat exchange into the low-pressure column (7), (f) introducing at least a portion of the condensate (13) obtained during the indirect heat exchange into the pressure column (4), (g) extracting a pressurized nitrogen fraction (10, 14, 15) as product from the upper region of the pressure column (4), characterized in that (h) the pressure of the third liquid fraction (17) from the lower region of the low-pressure column (7) is increased upstream of the indirect heat exchange (12) with condensing vapour (11) from the upper region of the pressure column (4), and (i) that portion (24) of the vapour which is obtained during the indirect heat exchange and is led back into the low-pressure column (7) is expanded (25) before being introduced (27) into the low-pressure column (7).

2. A method according to claim 1, characterized in that the expansion (25) of the vapour obtained during the indirect heat exchange is carried out in accordance with step (i) is work expansion.

3. A method according to claim 2, characterized in that at least a portion of the work obtained during the expansion (25) of the vapour obtained during the indirect heat exchange is used to compress (32) a process stream (31).

4. A method according to claim 1, characterized in that the vapour (22) obtained during the indirect heat exchange is heated (2) upstream of the expansion (25) in accordance with step (i).

5. A method according to claims 1, characterized in that a portion (23) of the vapour (22) obtained during the indirect heat exchange (12) is obtained as pressurized oxygen product.

6. A method according to claims 1, characterized in that an argon-containing fraction (35) is introduced from the low-pressure column (7) into a raw argon column (34).

7. Apparatus for obtaining oxygen and nitrogen at superatmospheric pressure by low-temperature separation of air in a rectification column system which has a pressure column (4) and- a low-pressure column (7), comprising:

(a) a feed air line (1, 3) for introducing compressed and purified feed air (1, 3) into the pressure column (4), (b) a first liquid fraction line (5), which connects the lower region of the pressure column (4) to the low-pressure column (7), (c) a second liquid fraction line (8), which connects the upper or middle region of the pressure column (4) to the low-pressure column (7), (d) a condenser/evaporator (12) whose evaporating chamber is connected via a third liquid fraction line (17) to the lower region of the low-pressure column (7), and whose condensation chamber is connected (via 10, 11) to the upper region of the pressure column (4), (e) a vapour line (22, 24, 26, 27) between the evaporation chamber of the condenser/evaporator (12) and the low-pressure column (7), (f) a fourth liquid fraction line (13) between the condensation chamber of the condenser/evaporator (12) and the pressure column (4), and having (g) a pressurized nitrogen product line (10, 14, 15) which is connected to the upper region of the pressure column (4), characterized by (h) means (18) for increasing the pressure in the third liquid fraction line (17), and (i) means (25) for reducing the pressure in the vapour line (22, 24, 26, 27) between the condenser/evaporator (12) and low-pressure column (7).

8. Apparatus according to claim 7, characterized in that the means for reducing the pressure have an expansion machine (25).

9. Apparatus according to claim 7, characterized by an oxygen product line (23) which is connected to the vapour line (22).

10. Apparatus according to claim 7, characterized by means (33) for transmitting mechanical energy from the expansion machine (25) to a compressor (32) for compressing a process stream (31).

11. Apparatus according to claims 7, characterized by a raw argon column (34) which is connected to the low-pressure column (35, 37).

* * * * *